US005625993A

United States Patent [19]

Kelly

[11] Patent Number: 5,625,993

[45] Date of Patent: May 6, 1997

[54] CONCRETE STRUCTURE HAVING LOAD TRANSFERRING INSERT AND METHOD FOR MAKING SAME

[75] Inventor: David L. Kelly, Sacramento, Calif.

[73] Assignee: The Burke Group, Sacramento, Calif.

[21] Appl. No.: 572,633

[22] Filed: Dec. 14, 1995

Related U.S. Application Data

[63] Continuation-in-part of Ser. No. 369,449, Jan. 6, 1995.

[51] Int. Cl.[6] ..... E04B 1/38

[52] U.S. Cl. ..... 52/704; 57/506.05; 57/698; 57/745.05

[58] Field of Search ..... 52/506.01, 506.05, 52/508, 697, 698, 704, 707, 710, 795.05, 795.09, 745.21

[56] References Cited

U.S. PATENT DOCUMENTS

| | | | |
|---|---|---|---|
| 1,948,093 | 2/1934 | Baird et al. | 52/707 |
| 2,952,947 | 9/1960 | White | 52/704 |
| 2,954,647 | 10/1960 | Lee | 52/707 |
| 3,095,672 | 7/1963 | Di Tullio et al. | 52/704 |
| 3,514,917 | 6/1970 | Merrill | 52/704 |
| 3,640,328 | 2/1972 | Tummarello | 151/41.7 |
| 3,715,851 | 2/1973 | Bennett | 52/707 |
| 4,618,464 | 10/1986 | Ditcher | 264/35 |
| 4,644,727 | 2/1987 | Hanson et al. | 52/687 |
| 4,719,724 | 1/1988 | Ditcher | 52/20 |
| 4,729,705 | 3/1988 | Higgins | 411/82 |
| 4,752,153 | 6/1988 | Miller . | |
| 5,257,490 | 11/1993 | Endo et al. . | |

FOREIGN PATENT DOCUMENTS

| | | |
|---|---|---|
| 664178 | 6/1963 | Canada . |
| 8813349 | 2/1989 | Germany . |
| 39 31 494 A1 | 4/1991 | Germany . |
| 21 140 118 | 11/1984 | United Kingdom . |

*Primary Examiner*—Carl D. Friedman
*Assistant Examiner*—Beth Aubrey
*Attorney, Agent, or Firm*—Limbach & Limbach L.L.P.

[57] ABSTRACT

A support member for a concrete structure comprises a Y-shaped hollow insert defining an internal channel having a Y-shaped cross-section. A V-shaped nut is inserted in V-shaped portion of the internal volume and end caps are placed over the ends of the insert to fully enclose the internal volume. The insert is then placed within a form for a concrete structure such that the base surface of the Y-shaped insert will be coplanar with a surface of the concrete after the concrete has been poured into the form and set. The base wall of the insert is then removed, thus exposing the internal volume. The distal end of a bolt can be inserted into the insert and fixed to the nut. The proximal end of the bolt extends out of the insert and beyond the surface of the concrete to be attached to equipment or another structure which is to be supported on the concrete structure.

43 Claims, 3 Drawing Sheets

FIG. 1A
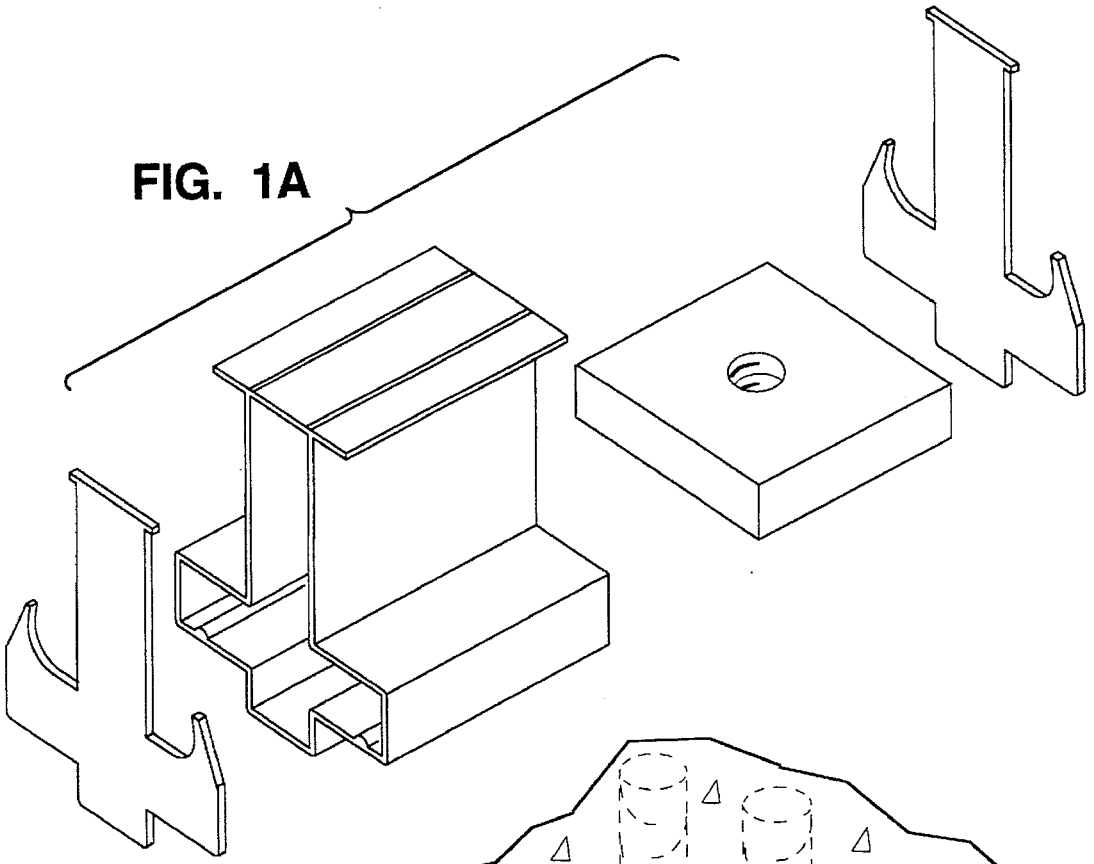
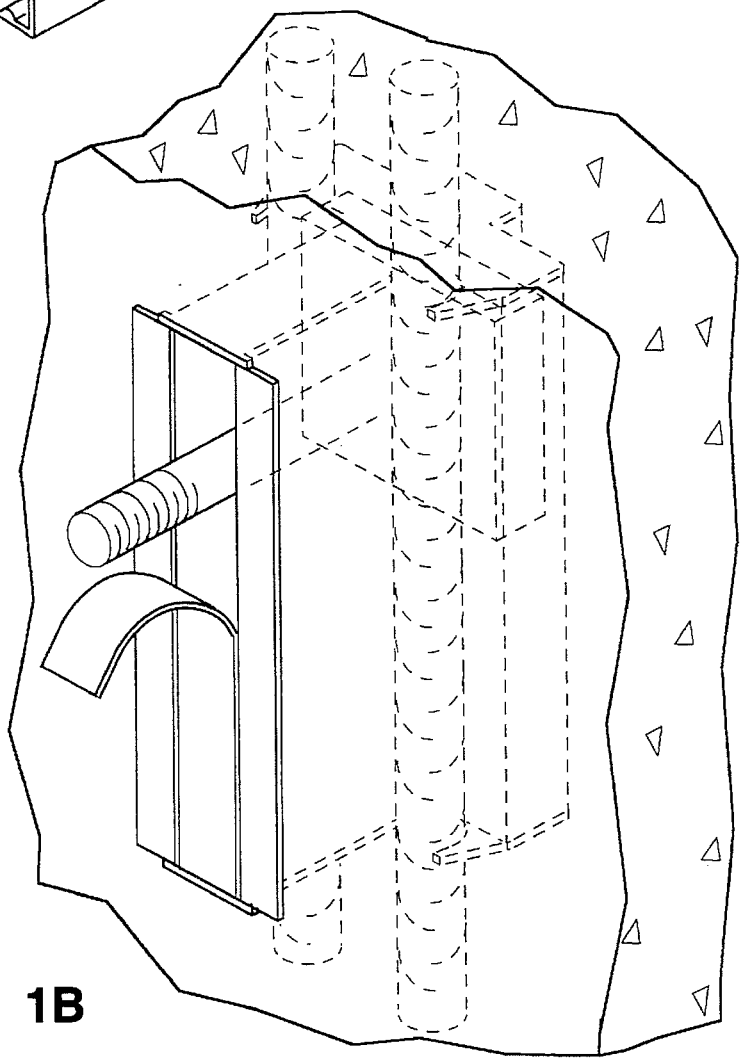
FIG. 1B

CONCRETE STRUCTURE HAVING LOAD TRANSFERRING INSERT AND METHOD FOR MAKING SAME

RELATED APPLICATIONS

This application is a continuation-in-part of patent application Ser. No. 08/369,449 filed on Jan. 6, 1995 entitled CONCRETE STRUCTURE HAVING LOAD TRANSFERRING INSERT AND METHOD FOR MAKING SAME, assigned to the assignee of record in the present application and incorporated herein by reference.

FIELD OF THE INVENTION

The invention pertains to a concrete structure having a support member for supporting the concrete structure on another object or supporting another object on the concrete structure. More particularly, the invention pertains to a concrete structure having a low-cost, high-strength support member within the concrete structure.

BACKGROUND OF THE INVENTION

In the construction of building structures, it is frequently necessary to support a concrete structure from another structure (concrete or otherwise). It is also frequently necessary to support heavy objects on or from concrete structures. For instance, in building constructions it may be necessary to support heavy pipes for fire suppression sprinkler systems from concrete ceilings or walls. Further, in certain industrial buildings, it may also be necessary to support heavy equipment on concrete floors, ceilings or walls. In certain industrial buildings, equipment may need to be slidably supported on a ceiling, wall or floor so that it can be moved along a defined path.

In order to support such heavy objects, the load should be supported from deep within the concrete structure so that the load is transferred throughout a large volume of the concrete. The larger the volume of concrete supporting the object, the heavier an object which can be supported without damaging the concrete structure. Accordingly, it is known to provide a primary support member, such as a hanger, nut or track, on the surface of the concrete. The object to be supported can be attached to the primary support member by means of a mating hanger or bolt. In order to transfer the load deep within the concrete, the bolt, hanger, track or other primary support member is attached to a secondary support member, such as a lug or a series of wires, buried deep within the concrete. Since the primary support member is on the surface of the concrete, it receives substantially no support from the concrete, except through the secondary support member which is buried within the concrete. Accordingly, the primary support member must be a heavy duty support member which is securely attached to the secondary support member, which also should be heavy duty.

Accordingly, both the primary and secondary support members must be heavy duty support members, adding significant cost.

In a situation where a heavy piece of equipment must be slidably supported in a track on a concrete structure, the track must be supported in the concrete by lugs or other secondary support members at closely spaced intervals. That is, since the heavy load may be positioned anywhere within the track, the track must be strongly supported over its entire length. There cannot be a significant distance between secondary support members for the track since, if the load is supported from a point in the track which is too distant from a secondary support lug, the load will not be effectively transferred from the track to a lug. Accordingly, the track may bend or be otherwise deformed under the weight of the load.

Further, it is frequently necessary to very precisely position a secondary support member in the concrete so that its corresponding primary support member will mate properly with the attachment hardware of another concrete structure or a piece of equipment to which it is to be attached. Accordingly, it is important to assure the proper placement of secondary support members since they are buried within the concrete and are generally immoveable after the concrete has set.

Patent application Ser. No. 08/369,449 discloses an apparatus comprising a concrete insert which is placed within a concrete wall which can support a support member within the wall and which achieves many of the goals discussed above. FIGS. 1A and 1B illustrate the apparatus disclosed in that application. A slotted insert is embedded within a concrete structure. Particularly, the slotted insert is a plastic extrusion molded insert elongated in a first direction and having a T-shaped cross-section perpendicular to the first direction. The insert is formed of a wall which defines an interior volume of the insert which also is T-shaped. The interior volume of the insert, therefore, defines an elongated channel extending in the first direction with the cross-section of the channel comprising two contiguous volumes, one being short and wide (the horizontal top of the T) and the other being long and thin (the vertical leg of the T).

Prior to assembly, the opposite ends of the channel are open so that a nut can be inserted from either end into the short and wide transverse portion of the channel. The two volumes are dimensioned so that the nut can fit horizontally within the transverse portion of the contiguous volume but cannot, in its horizontal orientation, fit through the vertical portion of the volume. Further, the nut preferably has a square perimeter, the sides of which are substantially equal in length to the width of the transverse portion of the volume, so that, once the nut is placed within the insert, it cannot be rotated. Once the nut is placed in the insert, end caps are attached to the open ends of the insert by glue or other means.

The insert is then positioned in the form within which the concrete structure will be poured and set such that when the concrete is poured, the base of the T-shaped insert (i.e., the bottom surface of the longitudinal leg) is coplanar with a surface of the concrete, but the remainder of the insert is embedded within the concrete. After the concrete has set, the wall of the insert which defines the base surface of the T is removed.

When it is necessary to support an object on the concrete structure, a bolt attached to the other structure or equipment can be inserted into and secured to the nut which is in the insert embedded within the concrete. Accordingly, the load is transferred, through the nut, deep within the concrete.

The two end caps have extensions protruding from the transverse portion of the T to form supporting feet. During fabrication of the concrete structure, the assembled insert, with the end caps in place, is positioned within the form within which the concrete structure is to be formed with the feet of the end caps resting on an inner surface of the form (i.e., the T is upside down). The insert, thus, is actually supported off of and above the inner surface of the form by the feet of the end caps. Accordingly, when the concrete is poured into the form, the transverse leg of the T will not be resting on the bottom surface of the form, but will instead be supported by the feet above the form a distance equal to the height of the feet. Thus, when the concrete is set, the top of the transverse portion of the insert will be embedded within the concrete rather than coplanar with a surface of the concrete. The height of the feet can be selected relative to the desired thickness of the concrete structure and the height of the insert to assure that the base of the T-shaped insert, within which the opening exists, will be coplanar with the opposite surface of the concrete structure. The feet prevent the bottom surface of the insert from being coplanar with the surface of the concrete when set. It is undesirable to have any interior volume of the insert unnecessarily coplanar with or close to the surface of the concrete structure within which it is embedded because it weakens the concrete structure overall.

Accordingly, it is an object of the present invention to provide a low-cost support member for concrete structures.

It is another object of the present invention to provide a support member for a concrete structure which is set deep within the concrete in order to supply sufficient load transfer to the concrete, yet still be moveable.

It is a further object of the present invention to provide a support member for a concrete structure which further transfers load to steel reinforcement bars embedded in the concrete.

It is yet one more object of the present invention to provide a slidable support member which transfers load deep within the concrete over the entire length of the slidable support member.

It is yet another object of the present invention to provide a support member in an insert embedded within a concrete structure in which the support member can have a height as great as the thickness of the concrete structure, thus maximizing the volume of concrete supporting the load, while minimizing the interior volume of the insert which is coplanar or close to the surface of the concrete.

It is yet a further object of the present invention to provide a support member embedded within a concrete structure which transfers the load supported by a support member within the insert to a greater volume of concrete than is known in the prior art.

SUMMARY OF THE INVENTION

The invention is a support member embedded within a concrete structure. Particularly, a hollow plastic extrusion molded insert is elongated in a first direction and has a Y-shaped cross-section perpendicular to the first direction. The walls of the insert define an interior volume of the insert which comprises an elongated channel having a Y-shaped cross-section. The cross-section can be considered to comprise two distinct, but contiguous sections, the V-shaped top of the Y and the longitudinal leg which extends vertically from the bottom of the V to the bottom of the Y.

The opposite ends of the channel comprise removable walls (or end caps). Prior to assembly, one or both of these walls are temporarily removed to open the channel so that a nut having a V-shaped side section can be inserted from either end into the V-shaped portion of the channel. The nut is dimensioned so that it substantially fills the V-shaped cross-section portion of the channel, but cannot fit through the longitudinal portion of the volume. Thus, when the nut is positioned within the insert, it cannot rotate within the channel or fit through the vertical portion of the channel. Also, the threaded hole in the center of the nut is aligned with the longitudinal portion of the interior volume of the insert such that the central axis of the hole and the central axis of the vertical leg of the insert are collinear. After the nut is positioned in the insert, the end caps are re-attached to the open ends of the insert.

The insert is then positioned in a form within which the concrete structure will be poured and set. According to one inventive method, the insert will be turned upside down and rested on the bottom surface of the form. Thus, when the concrete is poured into the form, the two tips at the top of the Y (now the bottom, since the Y is upside-down) will be coplanar with a surface of the concrete because they are resting on the form itself (which defines the surface of the concrete). However, the remainder of the insert is embedded within the concrete.

The height of the insert (i.e., the vertical distance between the bottom of the Y and the line defined by the top tips of the V portion of the Y) is equal to the desired thickness of the concrete structure to assure that the base of the insert will be coplanar with the opposite surface of the concrete structure.

After the concrete has set, the wall of the insert which defines the base surface at the bottom of the Y (the top, if it is upside down) is removed.

To support an object on the concrete structure, a threaded bolt on the object is inserted into the threaded hole in the nut and secured to the nut. Accordingly, the load is supported by the nut with the weight transferred through the nut deep within the concrete.

Since the insert is positioned in the concrete with the tips of the Y just flush with the opposite surface of the concrete, the load is transferred through the greatest distance of concrete possible. However, the integrity of that opposite side of the concrete is not significantly compromised since the tips of the Y comprise only thin lines, rather than a whole surface or volume, flush with the concrete surface. Further, because the load bearing surface of the insert is oblique to the surface of the concrete, the load is transferred through a greater volume of concrete than is achieved by a load bearing surface parallel to the concrete surface.

BRIEF DESCRIPTION OF THE DRAWINGS

FIG. 1A is a perspective exploded view of an apparatus in accordance with patent application Ser. No. 08/369,449.

FIG. 1B is a cut-away perspective view of the apparatus disclosed in patent application Ser. No. 08/369,449 embedded within a steel reinforced concrete structure.

DETAILED DESCRIPTION OF THE INVENTION

Figures 2, 3:
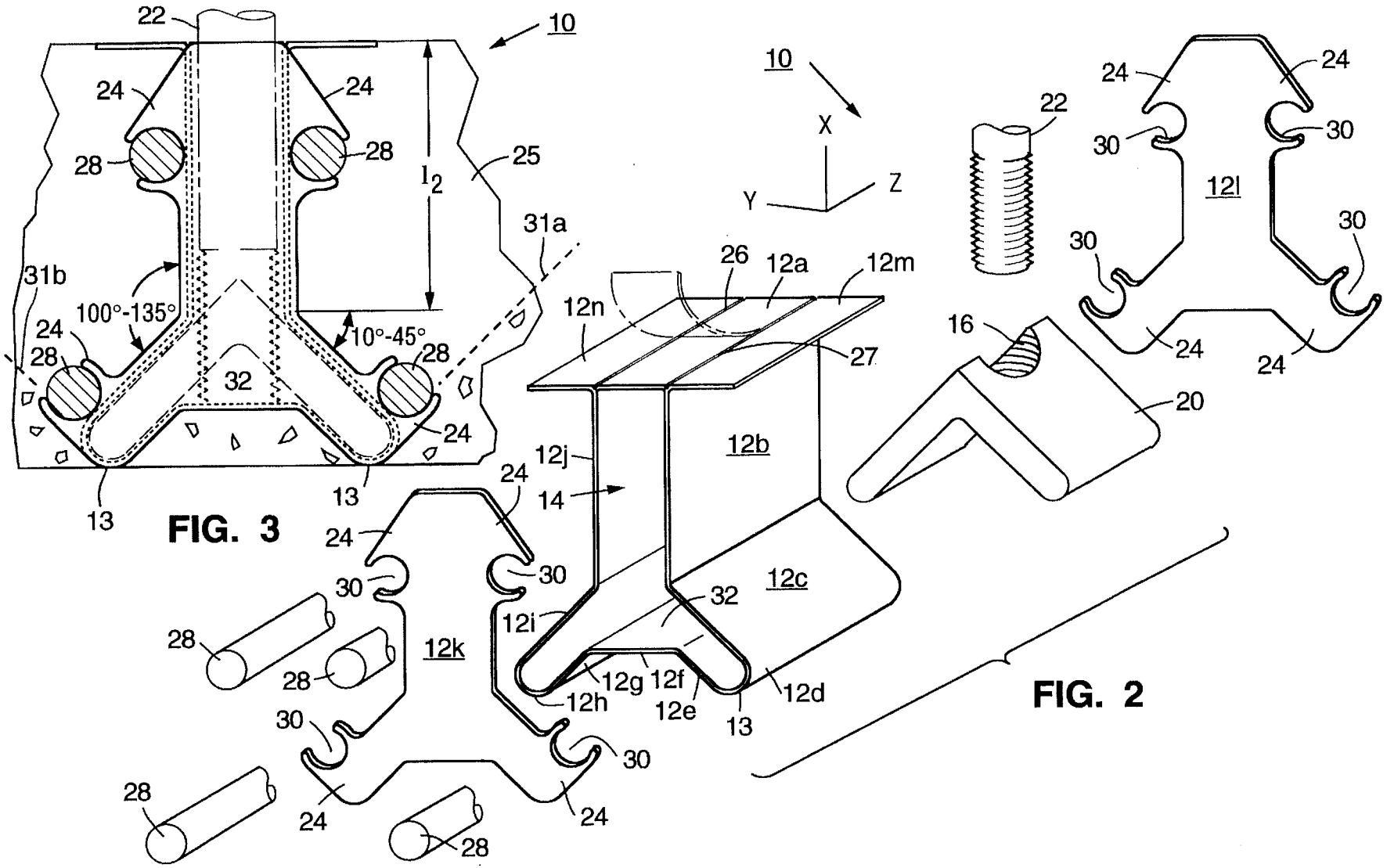
FIG. 2 is an exploded perspective view of the apparatus in accordance with a preferred embodiment of the present invention.
FIG. 3 is a cut-away end view of an apparatus embedded within a steel reinforced concrete structure in accordance with the embodiment of the present invention shown in FIG. 2.
Figure 4B:
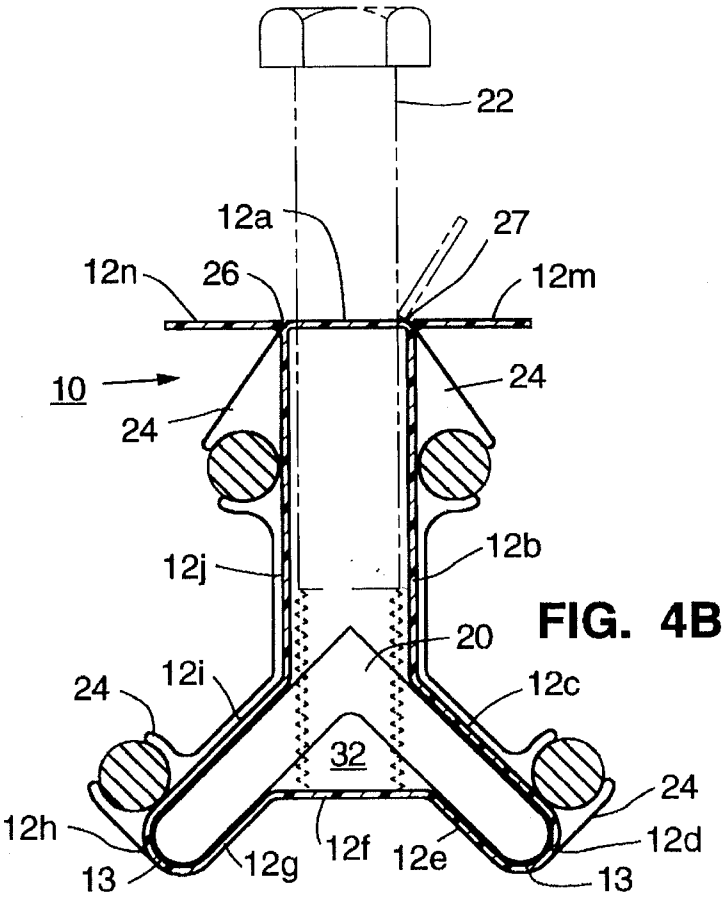
FIGS. 4A, 4B, and 4C are side, end and plan views, respectively, of the apparatus in accordance with the embodiment of the present invention shown in FIG. 2.
Figure 4C:
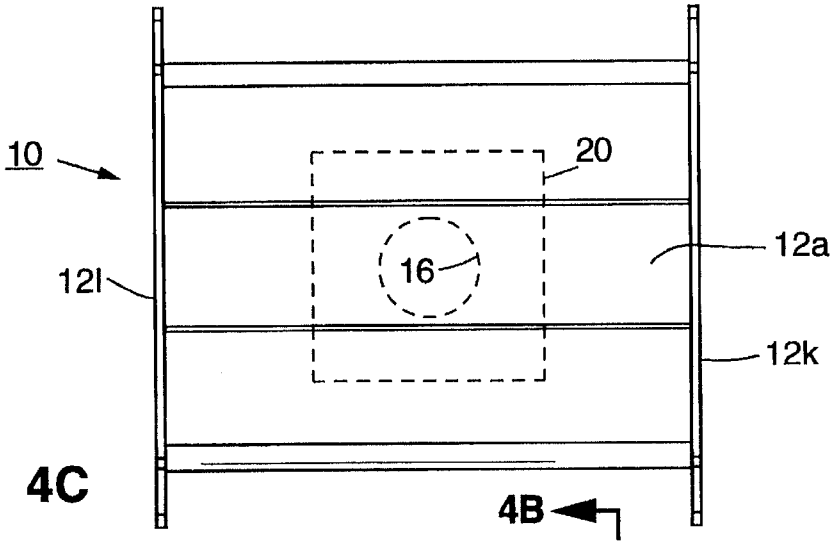
Figure 4A:
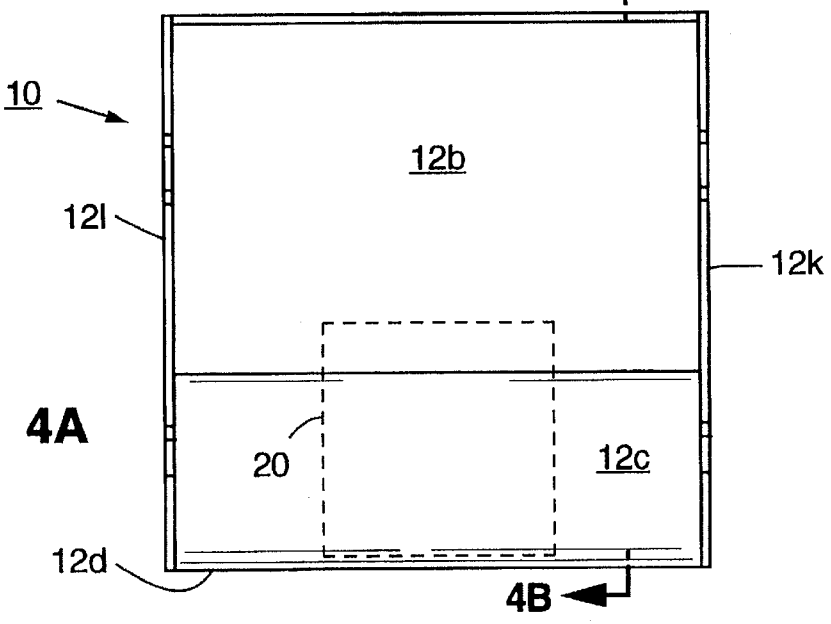

FIGS. 2, 3, 4A, 4B and 4C illustrate one preferred embodiment of the present invention. As shown, an insert 10 preferably formed of extruded plastic is elongated in a first direction, the z direction in the figures, and has a Y-shaped cross-section (shown upside-down in the Figures for reasons which will become clear) perpendicular to the z direction. The insert is hollow such that it defines an interior volume 14 which is of the same shape as the exterior of the insert, thus defining a channel extending in the z direction having a Y-shaped cross-section. The preferred embodiment of the insert shown in the Figures is herein considered to comprise twelve wall segments 12*a*–12*l* for sake of differentiation and ease in the discussion. However, it should be understood that the insert preferably is unitarily formed as a single plastic extrusion. Further, the number of wall segments distinctly identified in the Figures was selected for purposes of simplifying the description and is not a limitation on the invention.

In a preferred embodiment, the main portion of the insert comprising walls 12*a*–12*j* is formed of a single extrusion while walls 12*k* and 12*l* are separate.

Wall 12*a* defines the base of the Y. Walls 12*b* and 12*j* are parallel elongated side walls defining the longitudinal straight leg of the insert. Walls 12*c*, 12*d* and 12*e* define one stem of the V-shaped portion of the Y, while walls 12*g*, 12*h* and 12*i* define the opposing stem of the V-shaped (or divergent) portion of the Y. Wall 12*f* is parallel to wall 12*a* and connect the two stems of the V. Walls 12*a*, 12*b*, 12*c*, 12*e*, 12*f*, 12*g*, 12*i* and 12*j* are preferably planar and generally rectangular in shape. Walls 12*d* and 12*h* can be planar, but preferably are curved as shown in the figures so as to form semi-cylindrical surfaces. End walls 12*k* and 12*l* define the opposite ends of the channel and are planar and are generally Y-shaped so as to completely cover the ends of the channel formed within the insert.

The V-shaped portion of the interior volume 14 of the insert, which is defined by wall segments 12*c*–12*i*, is dimensioned so that a V-shaped nut 20 will fit within that volume and substantially fill the cross-section, as shown. The nut can be slid in the z direction in the channel, but is substantially immovable in the x and y directions. The longitudinal leg portion of the interior volume of the insert, which is defined by walls 12*a*, 12*b*, 12*f*, and 12*j*, partially overlaps the V-shaped portion, and is sized to accept a bolt 22 extending in the x direction so that the bolt can be screwed into and through a threaded hole 16 in the nut 20. The bolt has a thread and a diameter that mates with the threaded hole 16 in the nut 20.

In a preferred embodiment of the invention, flanges 12*m* and 12*n* extend from the insert 10 coplanar with the base wall segment 12*a*. Further, the edges 26 and 27 of wall segment 12*a* are formed of thinner plastic than the remainder of the insert so that wall segment 12*a* can be ripped along edges and 26 and 27 to remove it from the insert at a later time, as discussed below.

The end caps 12*k* and 12*l* are Y-shaped so as to completely cover the open ends 16 and 18 of the insert 10. After the nut is placed in the insert, the end caps 12*k* and 12*l* are attached to the opposing edges of the insert so as to fully enclose the internal volume of the insert. The end caps may be attached by adhesive, such as glue, or by other means.

According to a preferred embodiment of the invention, the end caps include additional extensions 24. These extensions define hanger portions within which steel reinforcement bars can be supported, as will be described below.

With reference to FIG. 3 in particular, a concrete structure 25 having one or more support members in accordance with the present invention is constructed as follows. The nut is inserted into the insert as previously described. Then, end caps 12*k* and 12*l* are fixedly attached to the ends of the insert by glue or other attachment means. The insert 10 is then placed in a form within which the concrete structure 25 is to be made. Particularly, the insert is laid on the bottom surface of the form such that the tips 13 of the Y rest on the bottom surface. With the end caps 12*k* and 12*l* in place, the internal volume of the insert is completely sealed so that the concrete can be poured and it will not enter the insert.

The height of the insert is equal to the desired thickness of the concrete structure. Thus, base wall segment 12*a* will be coplanar with the top surface of the concrete structure after the concrete is poured into the form and set.

Assurance that the base wall 12*a* will be coplanar with the surface of the concrete can be accomplished in several other manners also. For instance, the insert may be placed in the form with the base wall segment 12*a* facing downwardly and in contact with the bottom surface of the form. Accordingly, when concrete is poured into the form, it will not cover wall segment 12*a* since it is in contact with the bottom wall of the form (which defines the surface of the concrete). The insert can be prevented from moving during the concrete pour by nailing flanges 12*m* and 12*n* into the bottom surface of the form.

Alternately, insert 10 may be fixedly supported in the appropriate orientation and position by steel reinforcement bars 28 in the concrete. Particularly, extensions 24 on the end caps 12*k* and 12*l* include recesses 30 within which steel reinforcement bars 28 can be supported as shown in FIG. 2. The position of the reinforcement bars 28 in the form, the position of the recesses in the end caps, the length of various wall segments of the insert, and/or the thickness of the concrete are selected so that, when the insert is supported on the reinforcing bars, base wall 12*a* will be coplanar with a surface of the concrete structure.

Once the concrete sets, wall segment 12*a* can be grasped by a pair of pliers or other grasping tool and ripped off of the insert, thereby exposing the interior volume of the insert. Particularly, since the edges 26 and 27 are formed of a thinner material than the rest of the insert, those edges will rip, thus removing the wall segment 12*a* completely without removing any part of wall segments 12*b* and 12*i*.

A bolt 22 now can be inserted into the volume and screwed into nut 20. Volume 32 beneath the nut allows the distal end of the bolt to extend beyond the nut a short distance. This feature assures that the bolt can be fully inserted into and through the nut, thus providing maximum thread engagement between the bolt and the nut.

The bolt length is greater than the distance between wall 12*a* and 12*f* to ensure that the bolt will stick out of the insert when its distal end is threaded into the nut 20. The proximal end of the bolt, which sticks out of the insert, can be attached to another object upon which the concrete structure is to be supported or to an object which is to be supported by the concrete structure. The bolt may be threaded at its proximal end in order to allow attachment to the other object. Alternately, the proximal end of the bolt may be welded to the other object. Even further, the bolt may simply be an integral part of the other object.

In the present invention as described above, the nut acts as the load transferring member for transferring the load of the object through to the concrete. The nut 20 exerts force against walls 12*c* and 12*i*, thus providing load transfer through the wall segments 12*c* and 12*i* to the concrete and very high strength in the x and y directions.

Since the load is transferred to the concrete at an oblique angle to the surface of the concrete, the load is transferred to a greater volume of the concrete than if the load was transferred to the concrete perpendicular to the concrete structure's surface, as illustrated by the load transfer cone represented by lines 31*a* and 31*b* in FIG. 3. Thus, the present invention can support a heavier load than the insert disclosed in patent application Ser. No. 08/369,449. The angle of the load transferring surface of the nut relative to the surface of the concrete should be relatively small, on the order of 10–45 degrees. Alternately stated the angle should be about 100–135 degrees relative to the longitudinal leg of the insert. Particularly, in most practical applications of the invention, most of the load will be in the direction perpendicular to the surface of the concrete. Accordingly, most of the load should be transferred to the concrete in that direction. Since the load is transferred to the concrete in the direction perpendicular to the load transferring surface, that surface should be angled not more than 45° (half way) to the surface of the concrete.

In tests performed by the assignee of the present application, it was found that the T-shaped insert of patent application Ser. No. 08/369,449 having vertical length, $l_1$, of three inches had a pullout capacity of 5800 pounds. In other words, it took 5800 pounds of force perpendicular to the surface of the concrete to pull the support member out of the concrete (i.e., failure). Using the support member of the present invention with a vertical leg length, $l_2$, of only 2.75 inches, a pullout capacity of 14,000 pounds was achieved.

Further, the insert of the present invention can be embedded further into the concrete structure than the insert disclosed in patent application Ser. No. 08/369,449 because the V-shaped portion of the insert, which transfers the load to the concrete, can be embedded deeper in the concrete structure than the generally T-shaped insert of patent application Ser. No. 08/369,449. Particularly, in the support member of the patent application, space must be provided in the insert beneath the nut in order to allow the bolt to pass completely through the nut and extend out of the opposite side of the nut. A little extra distance than needed for the nut should be added in order to compensate for any debris which may collect within the insert beneath the nut. Even further, it is undesirable to have a surface of the insert coplanar with the opposite surface of the concrete structure. This is because a significant interruption in the surface of the concrete weakens the concrete structure. Thus, the insert of Ser. No. 08/369,449 should have a height less than the width of the concrete structure so that when the bolt opening is coplanar with one surface of the concrete structure, the opposite wall of the insert is embedded within the concrete, and not coplanar with the opposite surface. Cumulatively, all of these factors require that the load bearing surface of the nut typically be about 1 inch or more from the opposite surface of the concrete.

In the present invention, on the other hand, the overall height of the insert can be essentially equal to the thickness of the concrete since only a thin line of the insert, defined by the tips 13 of the Y (a small lineal portion of walls 12*d* and 12*h*) will be coplanar with the opposite surface of the concrete. This allows the load bearing surface 33 of the nut to slope down virtually to the opposite surface of the concrete.

The nut is freely movable in the z direction. The mobility in the z direction is advantageous for two reasons. First, it allows a margin of error or tolerance in the z direction since the support member (i.e., the nut 20) can be moved in the Z direction even after the concrete has set. Further, in applications where the nut is used to support equipment or other structures which are to be slidable along the surface of the concrete, the channel allows such mobility without the need for a surface mounted track and complex and expensive secondary support apparatus. Particularly, since the channel is embedded deep within the concrete, the nut can be slid anywhere within the channel and it will have equivalent load transfer through the concrete to provide extremely high strength load bearing in the x and y directions.

Even further, as shown in FIG. 2, when steel reinforcement bars 28 are used and engaged in the recesses 30, the load is transferred, not only to the concrete, but also to the reinforcement bars 28.

The dimension of the interior volume of the insert in the y direction may be selected to provide for some tolerance for misalignment in that direction also. In other words, the distance between walls 12*b* and 12*i* may be made slightly larger than the diameter of the bolt and the distance between walls 12*c* and 12*e* and walls 12*g* and 12*i*, respectively, may be made slightly greater than the depth of the nut. In this manner, the nut and bolt combination is moveable in the y direction a small amount also. Of course, however, the distance between wall segments 12*b* and 12*j* should not approach the width of the nut since wall segments 12*c* and 12*i* would no longer be able to sufficiently support the nut on the shoulder formed by those wall segments.

In embodiments of the invention in which slidable engagement of an object with the concrete structure is not necessary, the length of the channel (in the z direction) might be of as small as the width of the nut, but preferably is slightly longer in order to provide some tolerance in the z direction in positioning the insert. In embodiments in which the invention is to be used to provide a slidable mount for equipment or other apparatus, however, applicant envisions an insert having a length (in the z direction) of six inches to ten feet or greater.

Although the use of an insert is preferred, the present invention can be practiced without an insert. Particularly, the support member, including the V-shaped nut and a longitudinal bolt, may be set directly in the concrete without an insert. Further, the support member may simply comprise an integrally formed and generally Y-shaped member instead of a separate nut and bolt. In fact, even if an insert is employed, the nut and bolt may be replaced by an integrally formed Y-shaped support member which is adapted to be coupled at its base (the bottom of the Y) to the object to be supported.

Having thus described a few particular embodiments of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

I claim:

1. A concrete structure for supporting an object thereon, said structure having a first surface and comprising;

a support member substantially embedded within said concrete structure, said support member comprising, a longitudinal member generally perpendicular to said first surface and having a first end extending from said first surface, and a load transferring member connected to said longitudinal member, said load transferring member having a load transferring surface oblique to said first surface, and an insert disposed in said concrete structure and having an opening coplanar with said surface of said structure and the remainder of said insert being embedded within said concrete structure, said insert having an interior volume with first and second contiguous portions, said first portion sized and shaped to accept said load transferring member in a first orientation and said second portion sized and shaped such that said load transferring member does not fit into said second portion when in said first orientation and said longitudinal member does fit within said second portion, said support member being disposed in said insert with said load transferring member in said first portion in said first orientation, whereby said support member can be attached to said object and a load of said object is transferred through said concrete.

2. The concrete structure of claim 1 wherein said load transferring surface is at an angle in the range of about 10–45 degrees to said first surface.

3. The concrete structure of claim 1 wherein said load transferring member comprises a nut and said longitudinal member comprises a bolt which can be screwed into said nut.

4. The concrete structure of claim 1 wherein a portion of said wall defines a shoulder upon which said load transferring surface rests, said load being transferred to said concrete through said shoulder.

5. The structure as set forth in claim 1 wherein said support member and insert extend entirely through said concrete structure such that a tip of said support member is adjacent a second surface of said concrete generally opposite said first surface.

6. A concrete structure for supporting an object thereon, said structure having a first surface and comprising;

a support member substantially embedded within said concrete structure, said support member comprising a bolt generally perpendicular to said first surface and having a first end extending from said first surface and further comprising a nut connected to said longitudinal member, wherein said nut has a V-shaped cross-section, such that a load transferring surface of said nut is oblique to said first surface, and an insert disposed in said concrete structure and having an opening coplanar with said surface of said structure and the remainder of said insert being embedded within said concrete structure, said insert having an interior volume with first and second contiguous portions, said first portion sized and shaped to accept said nut in a first orientation and said second portion sized and shaped such that said nut does not fit into said second portion when in said first orientation and said bolt does fit within said second portion, said support member being disposed in said insert with said load transferring surface of said nut in said first portion in said first orientation, whereby said support member can be attached to said object and a load of said object is transferred through said concrete.

7. The concrete structure as set forth in claim 6 wherein said insert and said interior volume of said insert have cross-sectional shapes in a plane perpendicular to said first direction which are Y-shaped.

8. The concrete structure as set forth in claim 7 wherein said insert is formed of extruded plastic.

9. A concrete structure for supporting an object thereon, said structure having a first surface and comprising;

a support member substantially embedded within said concrete structure, said support member comprising a longitudinal member generally perpendicular to said first surface and having a first end extending from said first surface and further comprising a load transferring member connected to said longitudinal member, said load transferring member having a load transferring surface oblique to said first surface, and an insert disposed in said concrete structure and having a first opening coplanar with said surface of said structure and the remainder of said insert being embedded within said concrete structure, said insert having an interior volume with first and second contiguous portions, said first portion sized and shaped to accept said load transferring member in a first orientation and said second portion sized and shaped such that said load transferring member does not fit into said second portion when in said first orientation and said longitudinal member does fit within said second portion, said support member being disposed in said insert with said load transferring member in said first portion in said first orientation, whereby said support member can be attached to said object and a load of said object is transferred through said concrete, wherein said insert has a second opening sized and shaped to accept said load transferring member into said first portion in said first orientation, said insert further comprising an end cap sized and shaped to cover said second opening.

10. The concrete structure as set forth in claim 9 further comprising a reinforcement bar disposed in said concrete and wherein said insert comprises an extension extending beyond said wall of said insert and defining a recess for engaging said reinforcement bar in a position relative to said insert such that said load of said object is also transferred through said bar.

11. The concrete structure as set forth in claim 10 wherein said insert is elongated in a first direction parallel to said first surface such that said interior volume defines a channel extending in said first direction within which said support member can slide in said first direction.

12. A concrete structure for supporting an object on said structure, said structure having a first surface and comprising;

a support member substantially embedded within said concrete structure, said support member comprising a longitudinal member generally perpendicular to said first surface and having a first end extending from said first surface and further comprising a load transferring member connected to said longitudinal member, said load transferring member having a load transferring surface oblique to said surface, an insert disposed in said concrete structure and having a first opening coplanar with said surface of said structure and the remainder of said insert being embedded within said concrete structure, said insert having an interior volume with first and second contiguous portions, said first portion sized and shaped to accept said load transferring member in a first orientation and said second portion sized and shaped such that said load transferring member does not fit into said second portion when in said first orientation and said longitudinal member does fit within said second portion, said support member being disposed in said insert with said load transferring member in said first portion in said first orientation, whereby said support member can be attached to said object and a load of said object is transferred through said concrete, wherein said insert further comprises a flange extending outwardly from said insert coplanar with said first surface, whereby said flange provides a surface which can be tacked to a form for fixedly positioning said insert relative to said form.

13. The concrete structure as set forth in claim 12 wherein said flange comprises two flanges extending in opposite directions from said insert.

14. An apparatus for placement in a concrete structure for supporting an object thereon, said apparatus comprising;

a support member comprising a longitudinal member, and a load transferring member connected to said longitudinal member, said load transferring member having a load transferring surface oblique to said longitudinal member, whereby said support member can be substantially embedded within a concrete structure having a first surface with said longitudinal member generally perpendicular to said first surface and with a first end of said longitudinal member extending from said first surface and said load transferring surface oblique to said first surface and embedded within said concrete structure, an insert having an opening and an interior volume, said interior volume having first and second contiguous portions, said first portion sized and shaped to accept said load transferring member in a first orientation and said second portion sized and shaped such that said load transferring member does not fit into said second portion when in said first orientation and said longitudinal member does fit within said second portion, said support member being disposed in said insert with said load transferring member in said first portion in said first orientation.

15. The apparatus of claim 14 wherein said load transferring surface is at an angle in the range of about 100–135 degrees to said longitudinal member.

16. The apparatus of claim 14 wherein said insert is open at first and second ends positioned at opposite extremes of said insert in a first direction parallel to said first surface, said ends sized and shaped to accept said load transferring member into said first portion in said first orientation.

17. The apparatus of in claim 16 wherein said insert further comprises two removable end caps sized and shaped to completely cover said two open ends.

18. The apparatus of claim 14 wherein said insert is elongated in a first direction parallel to said first surface such that said interior volume defines a channel extending in said first direction within which said support member can slide in said first direction.

19. The apparatus of claim 14 wherein said first opening of said insert is covered by a removable wall.

20. The apparatus of claim 19 wherein said removable wall is formed integrally with said insert and includes a strip formed of a weaker material than the remainder of said wall, whereby said wall can be torn away from said insert with separation occurring at said strip.

21. The apparatus of claim 20 wherein said insert is formed of extruded plastic and wherein said strip is formed of thinner plastic than the remainder of the insert.

22. An apparatus for placement in a concrete structure for supporting an object on said concrete structure, said apparatus comprising;

a support member comprising a bolt and a nut connected to said bolt, said nut having a load transferring surface oblique to said bolt, whereby said support member can be substantially embedded within a concrete structure having a first surface with said bolt generally perpendicular to said first surface and with a first end of said bolt extending from said first surface and said load transferring surface of said nut oblique to said first surface and embedded within said concrete structure, and an insert having an opening and an interior volume, said interior volume having first and second contiguous portions, said first portion sized and shaped to accept said nut in a first orientation and said second portion sized and shaped such that said nut does not fit into said second portion when in said first orientation and said bolt does fit within said second portion, said support member being disposed in said insert with said load transferring member in said first portion in said first orientation, wherein said nut has a V-shaped cross-section.

23. An apparatus for placement in a concrete structure for supporting an object on said concrete structure, said apparatus comprising;

a support member comprising a bolt and a nut connected to said bolt, said nut having a load transferring surface oblique to said bolt, whereby said support member can be substantially embedded within a concrete structure having a first surface with said bolt generally perpendicular to said first surface and with a first end of said bolt extending from said first surface and said load transferring surface of said nut oblique to said first surface and embedded within said concrete structure, and an insert having an opening and an interior volume, said interior volume having first and second contiguous portions, said first portion sized and shaped to accept said nut in a first orientation and said second portion sized and shaped such that said nut does not fit into said second portion when in said first orientation and said bolt does fit within said second portion, said support member being disposed in said insert with said load transferring member in said first portion in said first orientation, wherein said insert further comprises a first sealable opening adjacent said second portion for allowing said bolt to extend out of said insert and a flange extending from said insert coplanar with said first opening, whereby said flange provides a surface attachable to a form for fixedly positioning said insert with said first opening in contact with said form, whereby said first opening will be coplanar with a surface of said concrete structure when poured and set in said form.

24. A method of fabricating a concrete structure having a support member embedded within the concrete of said structure for supporting an object on said concrete structure with a load of said object transferred through said concrete, said method comprising the steps of;

(1) providing a form defining a shape of said concrete structure, (2) providing a support member comprising a longitudinal member and a load transferring member connected to said longitudinal member, said load transferring member having a load transferring surface, (3) providing an insert, said insert comprising a first opening and an interior volume, said interior volume having first and second contiguous portions, said first portion sized and shaped to accept said load transferring member in a first orientation and said second portion sized and shaped such that said load transferring member does not fit into said second portion when in said first orientation and said longitudinal member does fit within said second portion, said support member being disposed in said insert with said load transferring member in said first portion in said first orientation, (4) placing at least said load transferring member of said support member in said insert with said load transferring member in said first orientation in said first portion, (5) positioning said insert in said form such that said insert and support member can be substantially embedded within said concrete structure with said longitudinal member generally perpendicular to a first surface of said concrete structure and with a first end of said longitudinal member extending from said first surface and said load transferring surface oblique to said first surface when said concrete structure is poured and set in said form, and (6) pouring concrete into said form such that no concrete enters said interior volume of said insert and so that said first surface of said concrete structure is formed coplanar with said opening of said insert.

25. The method of claim 24 wherein step (3) comprises placing said nut in said first portion of said insert and further comprising the step of;

(7) attaching said bolt to said nut after said concrete has set.

26. The method of claim 25 wherein said insert further comprises a removable wall over said opening and wherein step (7) comprises the steps of;

(7.1) removing said removable wall after said concrete is poured, and (7.2) inserting said bolt into said insert to engage said nut after said removable wall is removed.

27. The method of claim 25 wherein said insert is Y-shaped and said first opening defining the base of said Y and wherein said insert has a height measured between said opening and an opposite end of said insert substantially equal to a desired thickness of said concrete structure and wherein step (5) comprises positioning said insert such that said opposite end of said insert is flush with a surface of said concrete structure opposite said first surface.

28. A method of fabricating a concrete structure having a support member embedded within the concrete of said structure for supporting an object on said concrete structure with a load of said object transferred through said concrete, said method comprising the steps of;

(1) providing a form defining a shape of said concrete structure, (2) providing a support member comprising a longitudinal member and a load transferring member connected to said longitudinal member, said load transferring member having a load transferring surface, (3) providing an insert, said insert comprising a first opening and an interior volume, said interior volume having first and second contiguous portions, said first portion sized and shaped to accept said load transferring member in a first orientation and said second portion sized and shaped such that said load transferring member does not fit into said second portion when in said first orientation and said longitudinal member does fit within said second portion, and further comprising a second opening sized and shaped to accept said load transferring member into said first portion in said first orientation and said insert further comprising an end cap sized and shaped to cover said second opening said support member being disposed in said insert with said load transferring member in said first portion in said first orientation, (4) inserting said nut into said second opening, and (5) fixing said end cap to said second opening so as to completely enclose said interior volume of said insert such that concrete cannot enter said interior volume (6) placing at least said load transferring member of said support member in said insert with said load transferring member in said first orientation in said first portion, (7) positioning said insert in said form such that said insert and support member can be substantially embedded within said concrete structure with said longitudinal member generally perpendicular to a first surface of said concrete structure and with a first end of said longitudinal member extending from said first surface and said load transferring surface oblique to said first surface when said concrete structure is poured and set in said form, and (8) pouring concrete into said form such that no concrete enters said interior volume of said insert and so that said first surface of said concrete structure is formed coplanar with said opening of said insert.

29. An insert for embedding in a concrete slab, said insert comprising;

a hollow inverted Y-shaped body member having a divergent portion and a generally straight leg portion in open communication with said divergent portion; and, a nut of a divergent shape complemental to that of the divergent portion and having a screw-threaded opening therein accessible through the leg portion.

30. The insert of claim 29 further comprising a bolt which can be attached to said nut while positioned in said leg portion of said insert.

31. The insert of claim 30 further comprising a first sealable opening in said leg portion for allowing said bolt to extend out of said insert such that said first opening will be coplanar with a surface of said concrete slab.

32. The insert of claim 31 wherein said first sealable opening is covered by a removable wall.

33. The insert of claim 32 wherein said removable wall is formed integrally with said insert and includes a strip formed of a weaker material than the remainder of said wall, whereby said wall can be torn away from said insert with separation occurring at said strip.

34. The insert of claim 33 wherein said insert has a second opening sized and shaped to accept said nut into said divergent portion, said insert further comprising an end cap sized and shaped to cover said second opening.

35. The insert of claim 29 further comprising an extension protruding from said insert defining a recess for engaging a reinforcement bar in said concrete slab.

36. The insert of claim 29 wherein said insert is elongated in a first direction such that said interior volume defines a channel extending in said first direction within which said nut can slide in said first direction.

37. The insert of claim 31 further comprising a flange extending outwardly from said insert coplanar with said first sealable opening, said flange providing a surface which can be tacked to a concrete form for fixedly positioning said insert relative to said form.

38. The insert of claim 37 wherein said flange comprises two flanges extending in opposite directions from said first sealable opening.

39. The insert of claim 29 wherein said divergent portion extends from said leg portion at an angle in the range of about 100–135 degrees.

40. A concrete structure for supporting an object thereon, said structure having a first surface and comprising;

a support member substantially embedded within said concrete structure, said support member comprising, a longitudinal member generally perpendicular to said first surface and having a first end extending from said first surface, and a load transferring member connected to said longitudinal member, said load transferring member having a load transferring surface oblique to said first surface, wherein said load transferring surface is at an angle in the range of about 10–45 degrees to said first surface.

41. The concrete structure of claim 40 wherein said support member has a Y-shaped cross-section.

42. An apparatus for placement in a concrete structure for supporting an object thereon, said apparatus comprising;

a support member comprising, a longitudinal member, and a load transferring member connected to said longitudinal member, said load transferring member having a load transferring surface oblique to said longitudinal member, whereby said support member can be substantially embedded within a concrete structure having a first surface with said longitudinal member generally perpendicular to said first surface and with a first end of said longitudinal member extending from said first surface and said load transferring surface oblique to said first surface and embedded within said concrete structure, wherein said load transferring surface is at an angle in the range of about 100–135 degrees to said longitudinal member.

43. The apparatus of claim 42 wherein said support member has a Y-shaped cross-section.

* * * * *